US006036508A

United States Patent [19]

Anderson et al.

[11] Patent Number: 6,036,508

[45] Date of Patent: Mar. 14, 2000

[54] CONNECTOR FOR INTERCONNECTING A BUS BAR TO A CIRCUIT BOARD

[75] Inventors: W. Kyle Anderson; Randall M. Ekstrom, both of Rockford, Ill.

[73] Assignee: Hamilton Sundstrand Corporation, Rockford, Ill.

[21] Appl. No.: 09/217,423

[22] Filed: Dec. 21, 1998

[51] Int. Cl.[7] ..... H01R 9/09

[52] U.S. Cl. ..... 439/80

[58] Field of Search ..... 439/248, 247, 439/80, 79

[56] References Cited

U.S. PATENT DOCUMENTS

| | | | |
|---|---|---|---|
| 3,897,126 | 7/1975 | Frances et al. | 339/17 |
| 4,521,062 | 6/1985 | Kurbikoff et al. | 339/14 R |
| 4,580,862 | 4/1986 | Johnson | 439/248 |
| 5,007,846 | 4/1991 | Ravid | 439/79 |
| 5,083,927 | 1/1992 | Herard et al. | 439/80 |
| 5,090,117 | 2/1992 | Dickie | 439/248 |
| 5,090,911 | 2/1992 | Welsh | 439/248 |
| 5,261,828 | 11/1993 | Kandybowski | 439/247 |
| 5,554,041 | 9/1996 | Lallement | 439/248 |

*Primary Examiner*—Khiem Nguyen
*Assistant Examiner*—J. F. Duverne
*Attorney, Agent, or Firm*—Marshall O'Toole Gerstein Murray & Borun

[57] ABSTRACT

A connector includes a first end for floating securement to a circuit board such that the connector can move within a range of motion, a second end including a socket for receiving a pin of a bus bar and a conductor for electrically interconnecting the socket and the circuit board.

16 Claims, 3 Drawing Sheets

CONNECTOR FOR INTERCONNECTING A BUS BAR TO A CIRCUIT BOARD

TECHNICAL FIELD

The present invention relates generally to connectors, and more particularly to a connector for electrically and mechanically connecting two components together.

BACKGROUND ART

Often, there is a need to interconnect various components together in an electrical circuit. For example, in an aircraft, the generation and distribution of electrical power is controlled by an electrical power control unit (EPCU), which in turn includes a number of circuit boards (specifically, printed wiring boards or PWB's), a motherboard and a plurality of bus bars. Each PWB includes a first side mounted in an edge connector carried by the motherboard and control signals are passed through such edge connectors. In a first design, the bus bars are mounted on the motherboard and are coupled by further connectors to the PWB's. This arrangement has the Electrical disadvantage of locating the power conducted by the bus bars close to the control signals. In addition, access to screw type bus bar connections is difficult to achieve and the plug in connections to the bus bars are blind and also difficult to achieve. Still further, the need to secure two separate connectors (i.e., one power and one control) to each PWB can result in assembly tolerance problems or thermal mismatch which could result in unacceptable stress. Also considered was an approach in which multiple pins in the edge connector that also conducts the control signals; however, in the case where several daughter boards were used, this undesirably resulted in a very large combined current in the motherboard In a further arrangement intended to overcome at least some of the foregoing problems, the PWB's are interconnected at a second side opposite the motherboard by the bus bars. In this fashion, the control signals are advantageously kept remote from the power conducted by the bus bars. In one such design, each bus bar is coupled by screws extending through holes therein to threaded sockets carried on the second sides of the PWB's. In an alternative design, pins are carried by the bus bars and extend into unthreaded sockets carried by the PWB's. While this arrangement is effective to eliminate some of the problems noted above, there still remain the assembly tolerance and thermal mismatch problems resulting from the rigid connection of each PWB to the motherboard and the bus bars.

SUMMARY OF INVENTION

A connector for a circuit board provides a floating connection which obviates the problems noted with respect to previous designs.

More particularly, in accordance with one aspect of the present invention, a connector comprises a first end for floating securement to a circuit board such that the connector can move within a range of motion, a second end including a socket for receiving a pin coupled to a bus bar and a conductor for electrically interconnecting the socket and the circuit board.

In accordance with another aspect of the present invention, such a connector is combined with and is mounted on the circuit board. Preferably, the first end includes first and second spaced mounting members wherein a portion of the circuit board is disposed between the spaced mounting members and further includes aligned bores in the mounting members and the circuit board and a fastener disposed in the aligned bores. Still further in accordance with the preferred embodiment, the bore in the circuit board has a first cross sectional size and each of the bores in the mounting members has a second cross sectional size different than the first cross sectional size.

In accordance with an alternative embodiment, the first end includes a single mounting member, aligned bores are provided in the mounting member and the circuit board and a fastener, such as a rivet, is disposed in the aligned bores. A spacer may surround the fastener and a washer may be disposed in engagement with the fastener.

In either embodiment, means are provided for securing the conductor in a hole in the circuit board. Still further, the first end may include a shouldered portion for transferring insertion forces during insertion of the pin into the socket to the circuit board.

In accordance with yet another alternative aspect of the present invention, a connector electrically interconnecting a bus bar with a printed wiring board includes a first end secured to the printed wiring board such that the connector is movable within a range of motion relative to the printed wiring board and a second end including a socket receiving a connector pin of the bus bar. A wire electrically interconnects the socket and the printed wiring board and the first end further includes a shouldered portion for transferring insertion forces during insertion of the pin into the socket to the printed wiring board.

Other aspects and advantages of the present invention will become apparent upon consideration of the following drawings and detailed description.

DESCRIPTION OF THE PREFERRED EMBODIMENT

Figure 1:
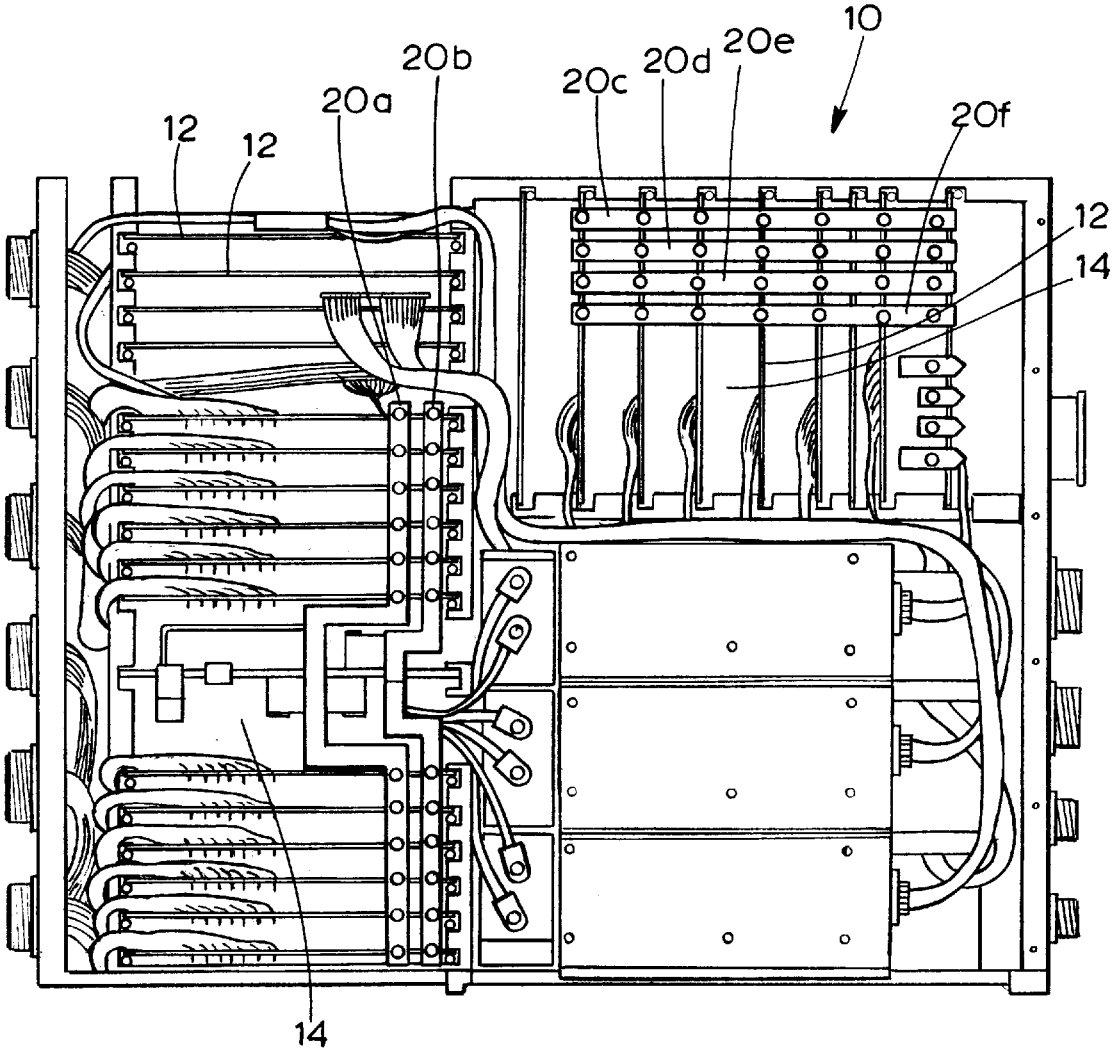
FIG. 1 comprises a plan view of an electrical power control unit (EPCU) incorporating the present invention.

Referring now to FIG. 1, an electrical power control unit (EPCU) 10, includes a number of printed wiring boards (PWB's) 12, all of which are electrically and mechanically coupled to a motherboard 14 forming a backplane of the EPCU 10. Specifically, lower sides (not visible in the FIGS.) of the PWB's 12 are mounted in edge connectors (also not shown) carried by the motherboard 14. Control signals are passed through the edge connectors between the PWB's 12 and the motherboard 14. A plurality of bus bars 20*a*–20*f* are mounted on upper sides of the PWB's opposite the motherboard 14 and conduct high voltage and current magnitudes (relative to the control signals) to/from the PWB's 12.

Figure 2:
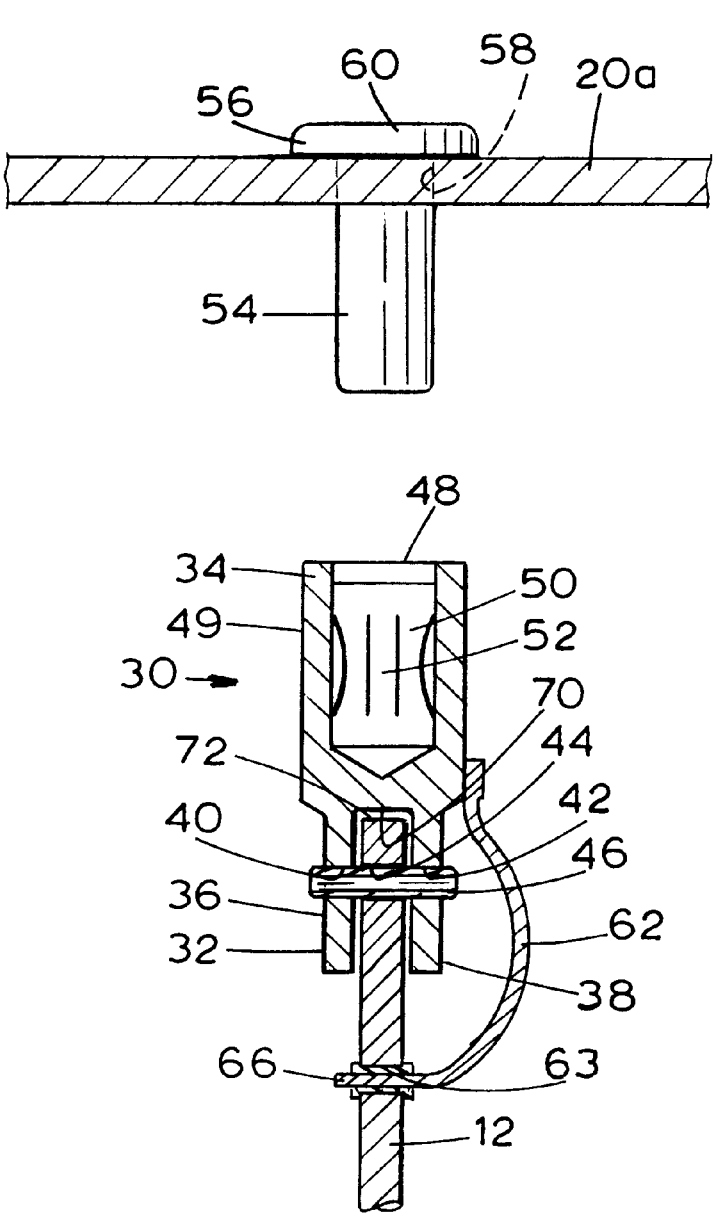
FIG. 2 is a side elevational view of a first embodiment of a connector according to the present invention.

FIG. 2 illustrates one of a number of connectors that mechanically and electrically interconnect the bus bars 20 (here, the bus bar 20*a*) to the PWB's. The connector 30 includes first and second ends 32, 34, respectively. The first end 32 includes a pair of arms or other members 36, 38 which together form a clevis that straddles the PWB 12. The arms 36, 38 include aligned bores 40,42, respectively, which are further aligned with a bore 14 in the PWB 12 when the parts are located as shown in FIG. 2. A roll pin 46 or other fastener is placed in the aligned bores 40, 42 and 44 to secure the connector 30 to the PWB 12.

The second end 34 includes a blind bore 48 formed in a connector body 49. The blind bore 48 receives a split-ring insert 50 fabricated of any suitable electrically conductive material which exhibits an elastic property. The insert 50 includes a plurality of arms 52 which bend inwardly at a midsection thereof to tightly grip a shank 54 of a pin 56 that extends through a hole 58 and which is brazed to the bus bar 20*a*. At the same time, the split-ring insert 50 is urged outwardly into tight engagement with the walls defining the blind bore 48. Preferably, the length of the shank 54 is less than the depth of the bore 48 such that the bus bar 20*a* is engaged with connector 30 firmly.

This bus bars 20 are maintained in contact with the connector 30 by open-cell foam or any other spring material disposed between the bus bay 20 and a cover (not shown).

A first end of a wire 62 or other flexible conductor is brazed or otherwise electrically connected to any convenient portion of the connector body 49 or at least one of the arms 36, 38. A second end 66 of the wire 62 is electrically connected by any suitable means, such as soldering, to a plated-through hole 63 in the PWB 12. Alternatively, this may be accomplished by soldering or otherwise securing a pin on the second end of the wire 62 and inserting the pin into the hole 63. In either event, the second end 66 of the wire or the pin and the hole 63 may have cross-sectional dimensions that cause the end 66 or the pin to be firmly retained in the hole 63 and/or the pin may be soldered or otherwise secured within the hole 63. Suitable traces or other conductors (not shown) are formed on the PWB 12 to distribute power between the bus bar 20*a* and components mounted on the PWB 12.

The distance between a surface 70 of the connector and the bores 40, 42 may be slightly greater than the distance between a top surface 72 of the PWB 12 and the bore 44 so that the connector 30 is capable of limited movement over a range of motion relative to the PWB 12. Alternatively, or in addition, the bore 44 may be made somewhat oversized in the up and down direction and/or in and out direction (as seen in FIG. 2) to obtain or enhance this floating connection or the bores 40 and 42 may be so oversized, in which case the bore 44 would be sized to firmly grip the roll pin 46. In any case, this limited range of movement advantageously accommodates manufacturing and assembly tolerances and dimensional variations resulting from thermal effects.

Preferably, the various parts are dimensioned so that, during insertion of the shank 54 into the bore 48, the surface 72 engages the surface 70 before the outer surface of the roll pin 46 engages the wall defining the bore 44. Thus, insertion forces developed during insertion of the pin 56 are applied over the relatively large area of the surface 72. This, in turn, prevents the roll pin 46 from applying localized forces to the PWB 12 so as to avoid damage to the latter.

Figure 3:
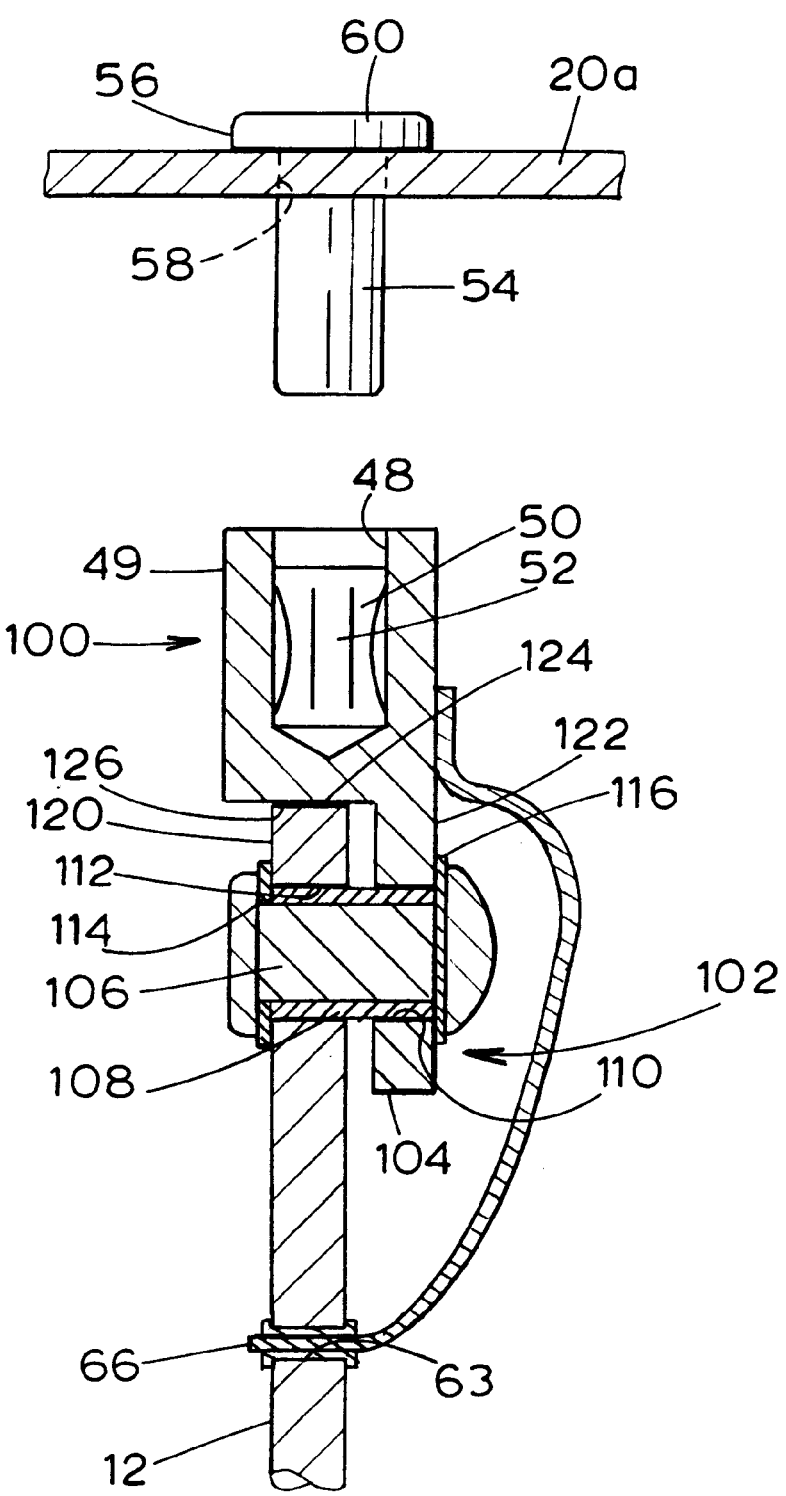
FIG. 3 is a side elevational view of a second embodiment of a connector according to the present invention.

FIG. 3 illustrates an alternate embodiment of a connector 100 wherein elements common to FIGS. 2 and 3 are assigned like reference numerals. In the embodiment of FIG. 3, the first end 32 is replaced by an end 102 having a single arm 104. A fastener in the form of a rivet 106 extends though a sleeve 108 disposed in aligned bores 110, 112 in the arm 104 and the PWB 12, respectively. The rivet 106 may further extend through washers 114, 116 disposed adjacent a surface 120 of the PWB 12 and a surface 122 of the arm 104.

As in the previous embodiment, the various parts are dimensioned so that there is a floating securement of the connector 100 relative to the PWB 12. Also as before, the parts are preferably so sized as to prevent localized assembly forces from being applied to the PWB 12 at the general location of the sleeve 108 and associated components during assembly, such forces instead being applied at the interface between surfaces 124 and 126 of the connector 100 and the PWB 12, respectively.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights of all modifications which come within the scope of the appended claims are reserved.

We claim:

1. A connector, comprising:

a conductive connector body having a first end for floating attachment to a circuit board such that the connector can move within a range of motion and a second end including a conductive socket for receiving a pin of a bus bar; and a conductor for electrically interconnecting the socket and the circuit board.

2. The connector of claim 1, in combination with and mounted on the circuit board.

3. The connector of claim 2, wherein the first end includes first and second spaced mounting members wherein a portion of the circuit board is disposed between the spaced mounting members and further including aligned bores in the mounting members and the circuit board and a fastener disposed in the aligned bores.

4. The connector of claim 3, wherein the bore in the circuit board has a first cross sectional size and wherein each of the bores in the mounting members has a second cross sectional size different than the first cross sectional size.

5. The connector of claim 2, wherein the first end includes a single mounting member, aligned bores in the mounting member and the circuit board and a fastener disposed in the aligned bores.

6. The connector of claim 5, wherein the fastener comprises a rivet.

7. The connector of claim 5, further including a spacer surrounding the fastener and a washer in engagement with the fastener.

8. The connector of claim 2, further including means for securing the conductor in a hole in the circuit board.

9. The connector of claim 1, wherein the first end includes a shouldered portion for transferring insertion forces during insertion of the pin into the socket to the circuit board.

10. A connector electrically interconnecting a bus bar with a printed wiring board, comprising:

a conductive connector body having a first end secured to the printed wiring board such that the connector is movable within a range of motion relative to the printed wiring board and a second end including a conductive socket receiving a connector pin of the bus bar and a wire which electrically interconnects the socket and the printed wiring board, the first end further including a shouldered portion for transferring insertion forces during insertion of the pin into the socket to the printed wiring board.

11. The connector of claim 10, wherein the first end further includes first and second spaced mounting members wherein a portion of the printed wiring board is disposed between the spaced mounting members and further including aligned bores in the mounting members and the printed wiring board and a roll pin disposed in the aligned bores.

12. The connector of claim 11, wherein the bore in the printed wiring board has a first cross sectional size and wherein each of the bores in the mounting members has a second cross sectional size different than the first cross sectional size.

13. The connector of claim 10, wherein the first end further includes a single mounting member, aligned bores in the mounting member and the printed wiring board and a fastener disposed in the aligned bores.

14. The connector of claim 13, wherein the fastener comprises a rivet.

15. The connector of claim 14, further including a spacer surrounding the rivet and a pair of washers in engagement with the rivet.

16. The connector of claim 10, further including means for securing the wire in a hole in the circuit board.

* * * * *